US010383415B1

(12) United States Patent
Graham et al.

(10) Patent No.: US 10,383,415 B1
(45) Date of Patent: Aug. 20, 2019

(54) TRAVEL BAG ASSEMBLY WITH A REMOVABLE CLOTHING RACK

(71) Applicants: Kenneth James Graham, Henderson, NV (US); Kara Lynn Mckee, Henderson, NV (US)

(72) Inventors: Kenneth James Graham, Henderson, NV (US); Kara Lynn Mckee, Henderson, NV (US)

( * ) Notice: Subject to any disclaimer, the term of this patent is extended or adjusted under 35 U.S.C. 154(b) by 190 days.

(21) Appl. No.: 15/355,150

(22) Filed: Nov. 18, 2016

Related U.S. Application Data

(60) Provisional application No. 62/257,330, filed on Nov. 19, 2015.

(51) Int. Cl.

| | |
|---|---|
| ***A45C 9/00*** | (2006.01) |
| ***A45C 5/06*** | (2006.01) |
| ***A45C 5/14*** | (2006.01) |
| ***A45C 13/02*** | (2006.01) |
| ***A45C 13/26*** | (2006.01) |
| ***A45C 7/00*** | (2006.01) |

(52) U.S. Cl.
CPC ..... *A45C 9/00* (2013.01); *A45C 5/06* (2013.01); *A45C 5/14* (2013.01); *A45C 7/0036* (2013.01); *A45C 13/02* (2013.01); *A45C 13/262* (2013.01)

(58) Field of Classification Search
CPC .... A45C 9/00; A45C 5/06; A45C 5/14; A45C 7/0036; A45C 13/02; A45C 13/262; A45C 7/0018; A45C 13/03
USPC .... 190/14, 13 R, 15 R; 206/287.1, 290, 286, 206/279; 211/118, 85
See application file for complete search history.

(56) References Cited

U.S. PATENT DOCUMENTS

| | | | | |
|---|---|---|---|---|
| 1,438,737 | A | 12/1922 | Witbeck | |
| 2,639,793 | A | 5/1953 | Hellman | |
| 4,538,709 | A | 9/1985 | Williams et al. | |
| 5,718,490 | A | 2/1998 | Liao | |
| 6,065,574 | A | 5/2000 | Miyoshi | |
| 6,264,047 | B1 * | 7/2001 | Crumley | A45C 13/03 190/102 |
| 6,269,922 | B1 * | 8/2001 | Gosse | A45C 3/00 190/107 |
| 6,401,890 | B1 | 6/2002 | Tan | |
| 6,481,574 | B1 * | 11/2002 | Pakosh | A45C 5/02 190/107 |
| 8,607,946 | B2 | 12/2013 | Tamarkin | |
| 9,101,187 | B2 * | 8/2015 | Zheng | A45C 7/02 |
| 2003/0098250 | A1 * | 5/2003 | Sabounjian | A47B 43/04 206/298 |
| 2005/0126872 | A1 * | 6/2005 | Dror | A45C 9/00 190/107 |
| 2007/0256994 | A1 * | 11/2007 | Jackson | A45C 9/00 211/85.3 |

(Continued)

*Primary Examiner* — Fenn C Mathew
*Assistant Examiner* — Cynthia F Collado
(74) *Attorney, Agent, or Firm* — H. John Rizvi; The Patent Professor

(57) ABSTRACT

A foldable travel bag assembly is provided including a foldable travel bag and a clothing rack, which is removably attachable to the foldable travel bag. The clothing rack can adopt a first position in which it is stored inside the travel bag, and a second position in which it is secured to the travel bag and extends upward and outward from the travel bag providing an upper hanging tube for hanging clothes. The longitudinal front and rear ends of the travel bag can fold inward for storage purposes.

20 Claims, 8 Drawing Sheets

(56) References Cited

U.S. PATENT DOCUMENTS

| | | | | |
|---|---|---|---|---|
| 2008/0283350 | A1 | 11/2008 | Vorderkunz | |
| 2009/0000894 | A1* | 1/2009 | Middup | A45C 5/14 190/15 R |
| 2009/0321204 | A1* | 12/2009 | Barkow | A45C 13/02 190/8 |
| 2014/0027225 | A1* | 1/2014 | Richards | A45C 7/0031 190/13 R |
| 2014/0060989 | A1* | 3/2014 | Johnson | A45C 13/001 190/102 |
| 2014/0262659 | A1* | 9/2014 | Hirsch | A47B 61/06 190/13 R |
| 2016/0143406 | A1* | 5/2016 | Collins | A45C 5/14 53/410 |
| 2017/0071302 | A1* | 3/2017 | McKelvey | A45C 9/00 |

* cited by examiner

TRAVEL BAG ASSEMBLY WITH A REMOVABLE CLOTHING RACK

CROSS-REFERENCE TO RELATED APPLICATIONS

This application claims the benefit of U.S. Provisional Patent Application Ser. No. 62/257,330, filed on Nov. 19, 2015, which is incorporated herein by reference in its entirety.

FIELD OF THE INVENTION

The present invention relates generally to travel accessories, and more particularly, to a travel bag assembly including a foldable travel bag and a clothing rack removably attachable to the travel bag, to facilitate easy storage and provide extended functionality.

BACKGROUND OF HE INVENTION

Most people would agree that luggage is the most important accessory needed for travel, especially long distance travel. Luggage generally refers to any bags, cases, and containers that hold a traveler's articles during transit. The articles can include, for example, clothing, toiletries, small possessions, trip necessities, and on the return-trip, souvenirs, gifts or the like. Luggage can be large or small, wheeled or non-wheeled, and soft or hard. Travelers can choose from a variety of different types and sizes of luggage based on their travel needs. Suitcases and duffel bags are the most common forms of luggage for modern day travelers. For air travel purpose, luggage or baggage can be generally categorized into two types: checked baggage or carry-on. Checked baggage is generally larger than carry-on baggage and is loaded into the airplane's baggage compartment, to which travelers do not have access during the flight; whereas carry-on baggage can be carried into the airplane's passenger compartment by the travelers and can be placed either in the overhead cabin or underneath the seat.

Today's travelers, especially business travelers, face many challenges, mostly involving time and space. There is often a need to hurry from one location to another with a limited amount of room to store clothing items, and sometimes a limited amount of time to change into them. Air travelers, in particular, are being stressed with increased amount of time in security checkpoints, time spent in checking in luggage, additional baggage fees for checked baggage, and time needed to claim baggage at destination. Therefore, many travelers choose to use carry-on bags only so as to save time and money. However, carry-on bags normally have limited space and functionality.

Business passengers, and other types of travelers including entertainers and performers, often have to carry specialized or formal clothing to their location and then quickly change into them when they get there. Presently, clothes can be packed into a regulation suitcase that tray contain a separate area, using compression straps, for suits and other types of clothing. These larger suitcases generally need to be checked when traveling by air. Another option is to use a smaller carry-on bag. When using either of these methods, most likely the clothing will come out wrinkled due to the insufficient amount of space inside the bag. One way to obtain more wrinkle-free space is to use a specialized garment bag. These types of bags are typically longer and wider, and also allow hangers to be used that allow clothing to be potentially more wrinkle-free when they are being removed. However, specialized garment bags take up extra space; in addition, they and add another item for the traveler to have to keep track of and have to check in, leading to increased bag fees. Their lack of wheels means they can cause more exertion when carrying, and if they have to be placed down on the ground, they may come into contact with a wet or dirty floor. They also sometimes may not perform as well as desired since the garments can still come out wrinkled, as they may have been folded either due to carrying them over an arm or shoulder, or storing them in an overhead bin, or in a cargo hold.

Frequently, business travels may involve both air travel and travel in a rental car. Travelers may take the garments they need to wear for the business purpose out of the luggage after arriving at the destination and getting the rental car, and hang them up in the car to de-wrinkle the garments. However, it is difficult to hang the garments straight as no clothing rack is normally available in a car.

In addition, most suitcases and travel bags take a large space for storage when not being used as they are generally not foldable. There are foldable bags currently available; however, they are generally made of soft material and do not provide the structure and strength of non-foldable suitcases and bags.

Therefore, there is an established need for an improved luggage item or bag that solves at least one of the aforementioned problems.

SUMMARY OF THE INVENTION

The present invention is directed to a convenient travel bag assembly including a travel bag and a collapsible and removable clothing rack. The travel bag assembly comprises a clothing rack that can be deployed for hanging clothes when the travel bag is expanded to provide a traveler the convenience of hanging garments while traveling or changing. The garment rack can be removably assembled onto inner side brackets of the bag. Tubes forming the garment rack can be stored inside the bag when not in use. A top cover of the bag opens to a side and can be extended vertically upward and hang from the garment rack, providing easy and quick access to pockets on an inner face of the top cover. The travel bag can foldable for easy storage when not being used, to reduce the total volume occupied by the bag when storing the bag.

In a first implementation of the invention, a travel bag assembly includes a travel bag defining an inner space for storing clothing, and a clothing rack removably attachable to the travel bag. The travel bag assembly is configured to adopt a first position in which the clothing rack is stored inside the travel bag, and a second position in which the clothing rack is secured to the travel bag and extends upward and outward from the travel bag providing at least one clothes hanging tube in an elevated, spaced-apart relationship with the travel bag.

In a second aspect, the travel bag assembly can further include at least one bracket on an inner face of the travel bag. When the travel bag assembly is arranged in the second position, the clothing rack is disconnectably connected to the inner face of the travel bag via the at least one bracket. The brackets can safely secure the clothing rack without altering the external appearance of the travel bag.

In another aspect, the travel bag assembly can further include a locking mechanism that retains the clothing rack within the at least one bracket when the travel bag assembly is arranged in the second position. The locking mechanism can enhance the ability of the clothing rack to stably carry multiple clothing items.

In another aspect, the travel bag assembly further includes a top cover that can be opened and closed to respectively allow or prevent access to the inner space of the travel bag. The travel bag assembly can further adopt a third position in which the top cover extends in an upwardly elevated position from the travel bag and is secured to the clothing rack to maintain the upwardly elevated position. The elevated cover can contribute to maintain the clothing rack in a stable, upright operational position.

In another aspect, a strap can be attached to the top cover and is configured to extend from the top cover to the clothing rack when the travel bag assembly is in the third position. The strap can further contribute to stabilize the clothing rack. For instance, the strap can be manually or elastically length-adjustable to allow tightening of the strap and thus applying a tension or pulling force between the travel bag and the clothing rack, thus increasing stability of the clothing rack.

In another aspect, the top cover can include at least one pocket accessible through a pocket opening. The pocket opening of each pocket can be arranged above the pocket when the travel bag assembly is arranged in the third position, allowing items to retrain within the pockets due to gravity.

In another aspect, the at least one pocket can be arranged on an inner face of the top cover, the inner face configured to face inward and remain concealed when the top cover is closed preventing access to the inner space of the travel bag. The pockets, and items stored therein, can thus be safely stored inside the travel bag when the top cover is closed.

In yet another aspect, the top cover can be secured to the clothing rack by a hook fastener when the travel bag assembly is arranged in the third position. The hook fastener provides a convenient and robust attachment between the top cover and clothing rack.

In another aspect, the top cover can be secured to an upwardly extending side tube of the clothing rack when the travel bag assembly is arranged in the third position. Alternatively or additionally, the top cover can be secured to the at least one clothes hanging tube when the travel bag assembly is arranged in the third position.

In another aspect, when the travel bag assembly is arranged in the third position, at least one side tube of the clothing rack can extend upward from the travel bag and carry the at least one clothes hanging tube in a male-female fitting connection with one another. The top cover can be secured to the at least one clothes hanging tube and enhance the male-female fitting connection by pulling downward due to gravity.

In another aspect, the clothing rack can include two side tubes. When the travel bag assembly is arranged in the second position, the side tubes can extend upward from the travel bag in a spaced apart configuration and carry the at least one clothes hanging tube.

In yet another aspect, the travel bag assembly can further include one or more brackets on a respective inner face of two opposite sides of the travel bag. The one or more brackets of each respective inner face can disconnectably connect a respective one of the two side tubes of the clothing rack to the respective inner face of the travel bag.

In another aspect, when the travel bag assembly is arranged in the second position, the at least one clothes hanging tube can extend in a front-to-back, longitudinal direction of the travel bag assembly. The travel bag can include a pair of wheels on a back thereof and at least one handle on a front thereof.

In another aspect, a respective set of one or more brackets can be carried on a front side and a rear side of the travel bag.

In another aspect, the travel bag can be foldable or collapsible.

In yet another aspect, at least one side of the travel bag can include two rigid portions. A bending line can be formed between the two rigid portions allowing the at least one side to fold towards the inner space of the travel bag.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient foldable travel bag with a removable clothing rack that is capable of being folded for easy storage when not in use and being attached with the removable clothing rack when the travel bag is expanded.

Figure 1:
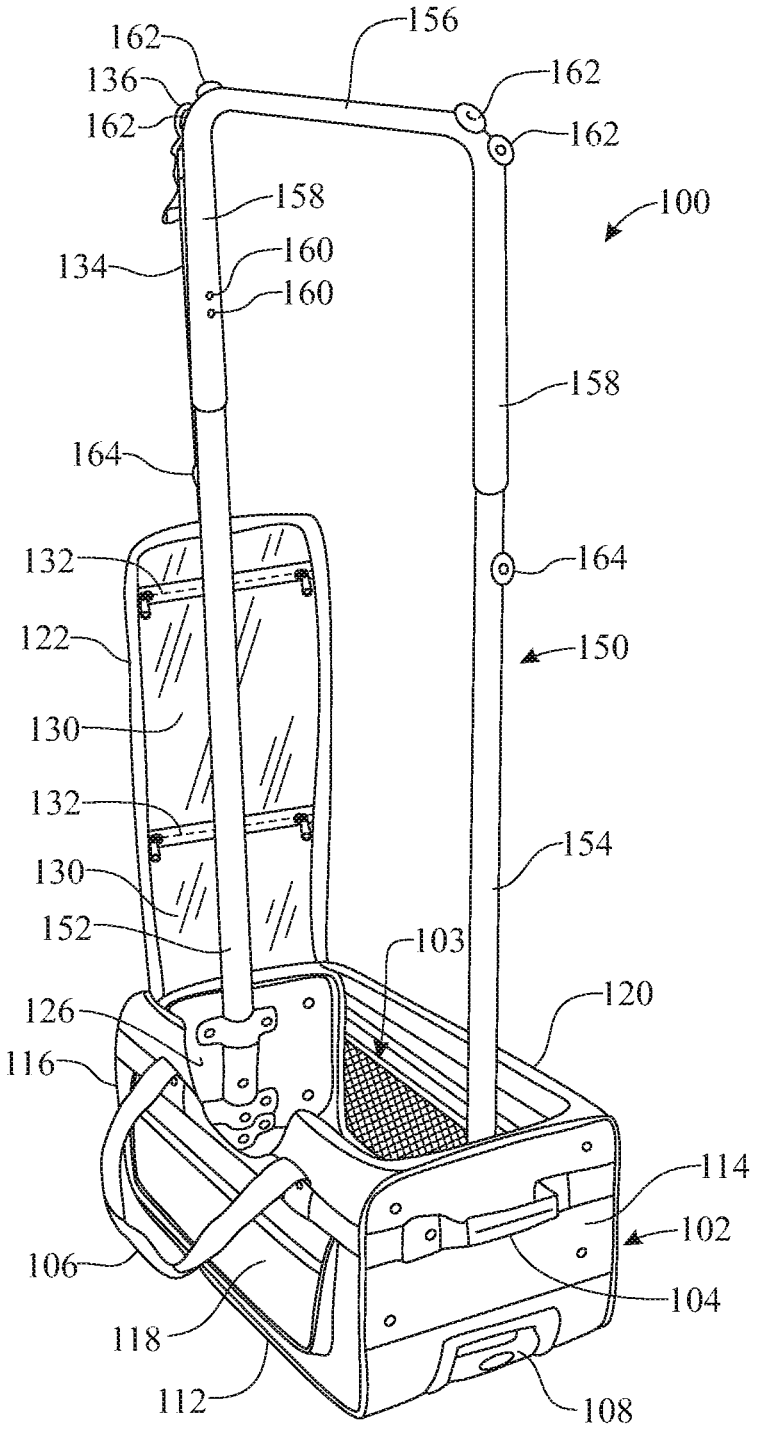
FIG. 1 presents a perspective view of a foldable travel bag assembly comprising a foldable travel bag and a removable clothing rack in accordance with an exemplary embodiment of the present invention, the clothing rack shown assembled onto the travel bag and the top cover of the travel bag shown hooked to the clothing rack.
Figure 2:
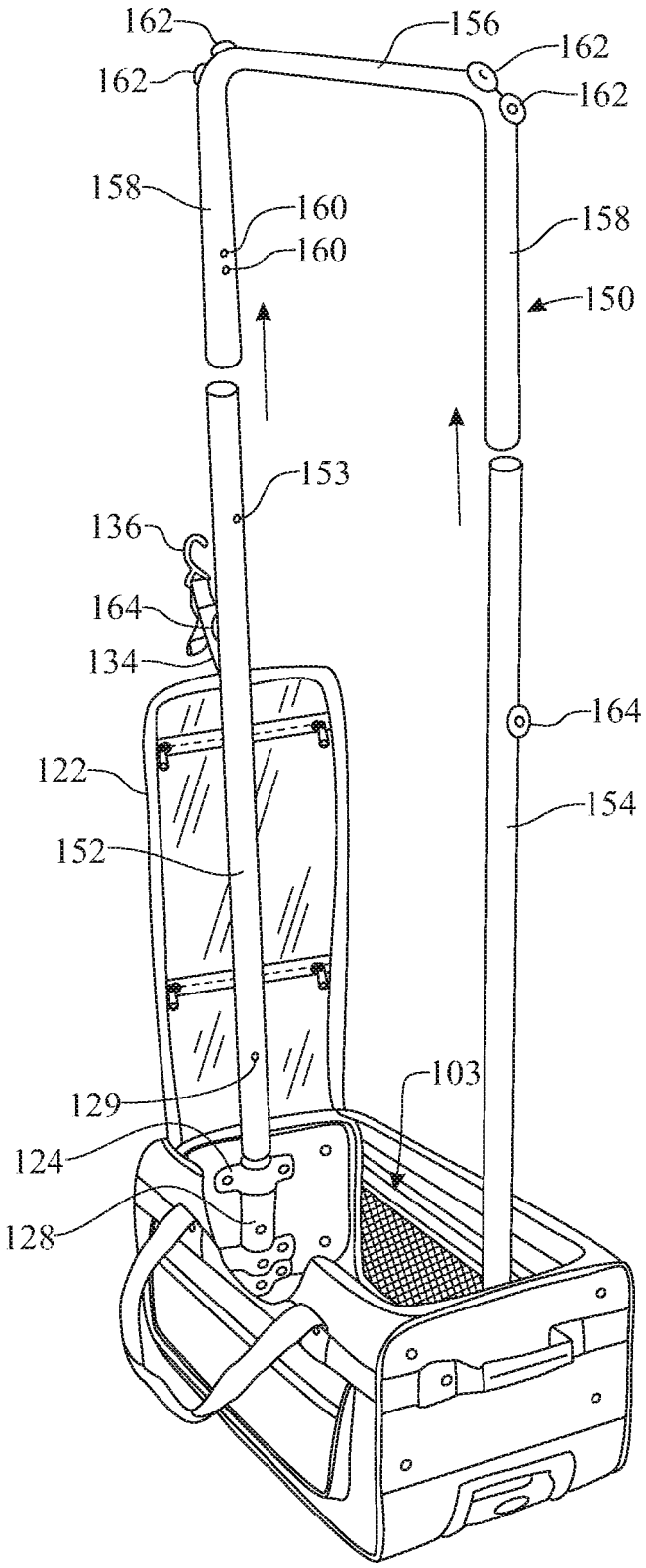
FIG. 2 presents an exploded perspective view of the foldable travel bag assembly of FIG. 1.

Referring initially to FIGS. 1 and 2, a foldable travel bag assembly 100 is illustrated in accordance with an exemplary embodiment of the present invention. As shown, the foldable travel bag assembly 100 includes a foldable travel bag 102 and a removable clothing rack 150 which can be configured to extend vertically upward from the travel bag 102 as best shown in FIG. 1. The foldable hag 102 defines an inner space 103 for storing clothes and other personal items, as known in the art. The foldable bag 102 depicted herein includes a fixed front handle 104, a pair of opposing top handles 106, an extendable front handle 108, a set of wheels 110 (FIG. 3) on a longitudinal rear end thereof, a bottom side 112, a longitudinal front side 114, a longitudinal rear side 116, two opposed lateral sides 118 and 120, and a top cover 122. One of ordinary skill in the art will understand that alternative types of wheel arrangements, if any, travel bag shapes, and handle arrangements may be employed construct the present invention; these various arrangements will not be described in detail so as not to obscure the invention.

The removable clothing rack 150, in turn, includes two side tubes 152 and 154 and a top hanging tube 156 that can be connected to or disconnected from the side tubes 152 and 154. In some embodiments, such as in the present embodiment, the top hanging tube 156 is U-shaped and the side tubes 152 and 154 are straight, and side portions 158 of the top hanging tube 156 couple to the side tubes 152 and 154. For instance and without limitation, the side portions 158 can couple to the side tubes 152 and 154 in a male-female connection, such as by having the side tubes 152 and 154 fit into the side portions 158 as shown herein. In some embodiments, the clothing rack 150 is adjustable in height. For instance and without limitation, the male-female connection between the side portions 158 and the side tubes 152 and 154 can be locked to different depths, such as by having the side portions 158 provided with several locking holes 160 and by having the side tubes 152 and 154 include a spring-biased pin 153 (FIG. 2) for selectively engaging with one of the several locking holes 160. In some embodiments, instead, the side portions 158 may include a single locking hole 160, allowing to simply lock the top hanging tube 156 to the side tubes 152, 154. Alternative embodiments are contemplated in which the top hanging tube 156 and the side tubes 152, 154 are retained in an assembled position by friction. Further embodiments are contemplated in which the number of tubes may vary. For instance, while the present embodiment includes two side tubes 152, 154 protruding from the travel bag 110 and supporting the clothing rack 150, it is contemplated that the number of tubes attached to and protruding from the travel bag 110 can span from one to any applicable number of tubes. In addition, the tubes 152, 154 and 156 described herein or, in general, any tube forming the clothing rack, may be divided in two or more segments or shorter tubes to facilitate storing the clothing rack 150 in a smaller travel bag 110 configuration. Further embodiments are contemplated in which any of the tubes forming the clothing rack is telescopically expandable and contractible, to reduce storage space required by the clothing rack when not in use.

Figure 8:
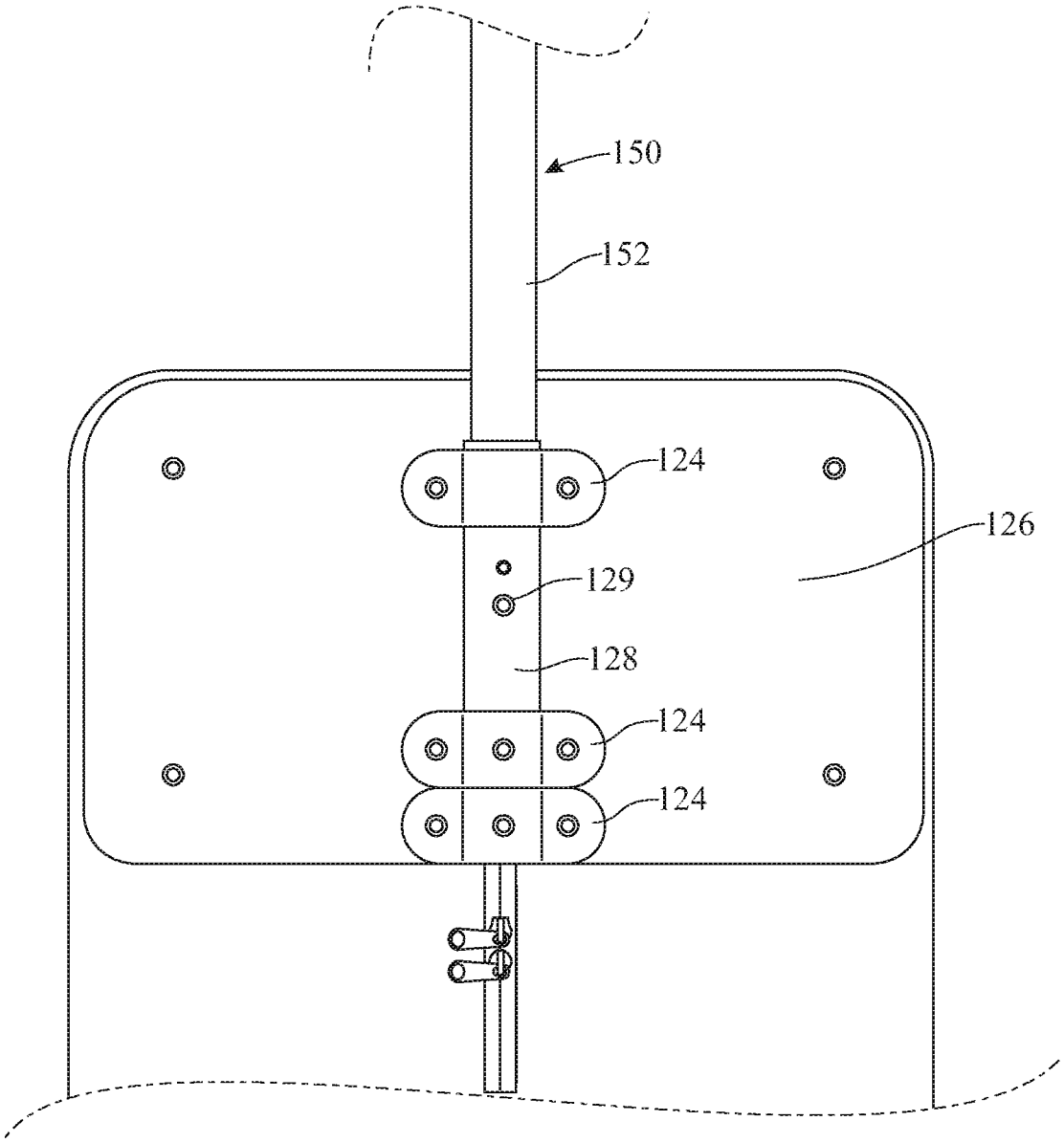
FIG. 8 presents an enlarged partial elevation view of the inner side of the longitudinal rear side of the travel bag, showing the brackets and female receiving tube, and further showing one of the side tubes of the clothing rack fitted into the female receiving tube and locked in place by a transverse locking pin.
Figure 9:
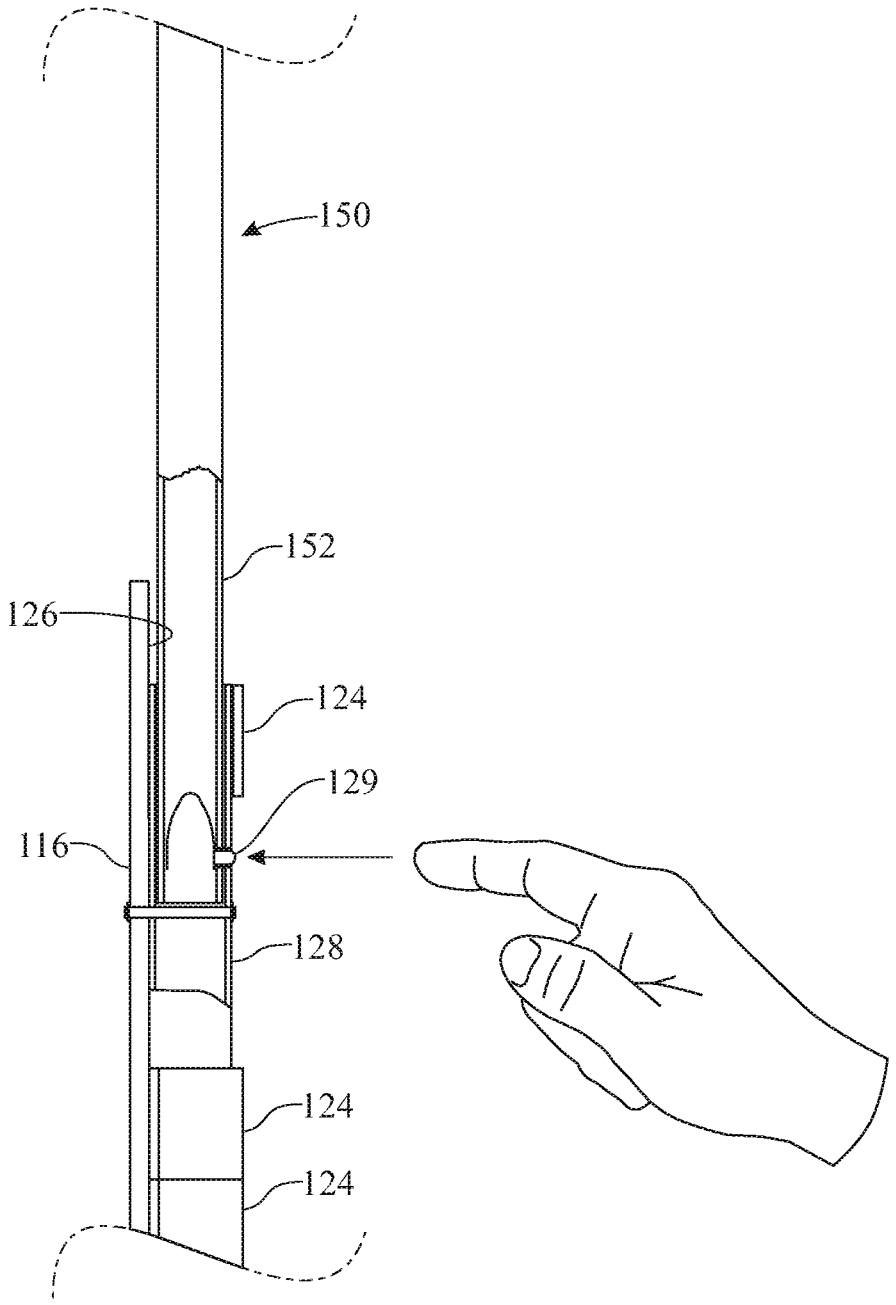
FIG. 9 presents a schematic cross-sectional left side elevation view of the assembly of FIG. 8, illustrating a sequence of unlocking the transverse locking pin to free the side tube of the clothing rack from the female receiving tube.

As shown in FIGS. 1 and 2, the clothing rack 150 can be removably assembled onto the travel bag 102. When not in use, the tubes forming the clothing rack 150 can be stored inside the travel bag 102, such as in pockets provided specifically therefor. To facilitate assembly of the clothing rack 150 in the elevated position of FIG. 1, the longitudinal rear side 116 can have brackets 124 formed on or attached to an inner face 126, as shown in FIGS. 1, 2, 8 and 9. The brackets 124 hold a female receiving tube 128 for receiving the side tube 152 therein. Similarly, though not shown in the drawings, the longitudinal front side 114 can have brackets and a female receiving tube for receiving the side tube 154. Referring now to FIG. 8, a locking mechanism 129, for example a transverse spring-biased locking pin, can be provided to lock the side tube 152 in place after being inserted into the receiving tube 128. Although not shown, it is understandable that the same mechanism can be provided to lock the side tube 154 that is attached to the longitudinal front side 114. As shown in FIG. 9, a user can push the spring-biased locking pin or locking mechanism 129 inward to free the side tube 152 and allow removal of the side tube 152 from the receiving tube 128.

Figure 3:
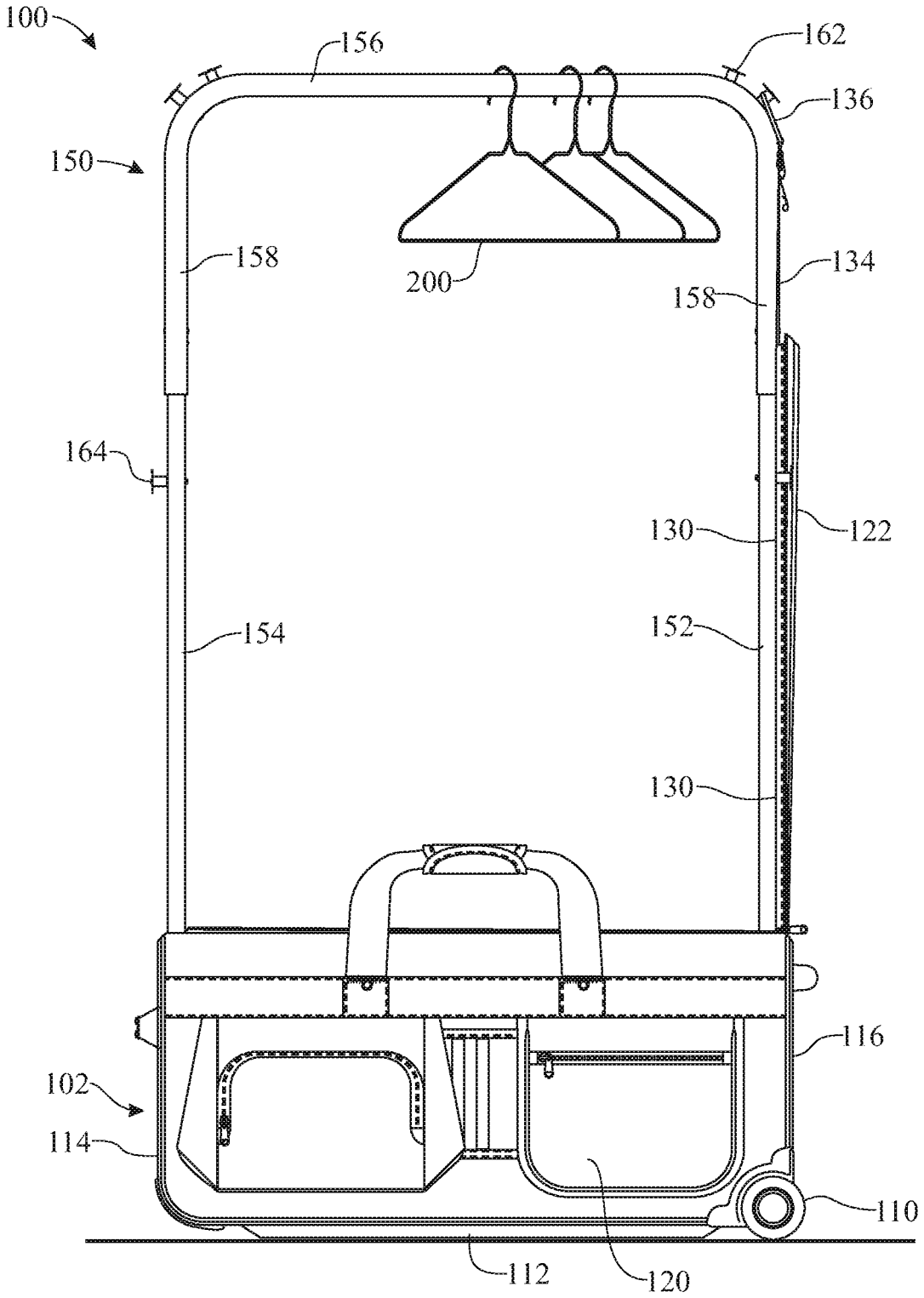
FIG. 3 presents a right side elevation view of the foldable travel bag assembly of FIG. 1.
Figure 5:
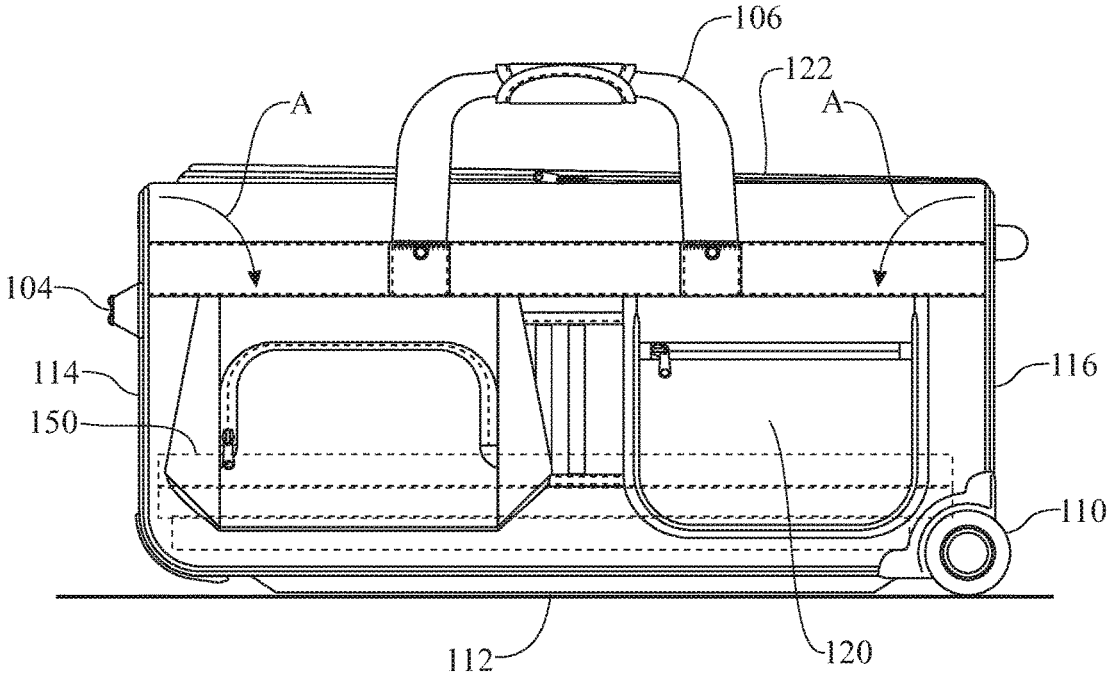
FIG. 5 presents a right side elevation view of the foldable travel bag assembly of FIG. 1, shown in a closed position and indicating the direction in which the longitudinal front and rear sides can be folded inward.

The top cover 122 is movably connected to the remainder of the travel bag 102, such as to a top edge of the longitudinal rear side 118, and opens by pivoting upward in order to enable accessing the inner space 103 of the travel bag 102. As shown in FIG. 3, the top cover 122 opens to a side, such as towards the longitudinal end of the travel bag 102, and can be extended vertically upward and hang from the clothing rack 150. Such an elevated, hanged arrangement of the top cover 122 can provide several advantages. Firstly, the top cover 122 can be easily set out of the way of the user without having to fold or roll the cover as in conventional luggage items. In addition, the top cover 122 can be fitted with pockets 130 on an inner face thereof, the inner face remaining facing inwardly and concealed when the top cover 122 is in a closed position (FIG. 5). The pockets 130 can be readily accessible to the user when the top cover 122 is secured in the elevated, hanging position of FIG. 1. Preferably, the pockets 130 and pocket openings 132 are arranged in such a way that the pocket openings 132 are oriented upwards, i.e. above their corresponding pocket 130, when the top cover 122 is arranged in the elevated position, as shown in FIG. 1, in order to retain items within the pockets 130 by gravity.

In order to secure the top cover 122 in the elevated position, the top cover 122 can be provided with a fastener which attaches to the clothing rack 150. For instance, the top cover 122 of the present embodiment is provided with a strap 134 ending in a fastener such as a hook 136. The hook 136 is configured to engage with a hook receiver 162, 164 provided on the clothing rack 150. The hook receiver 162, 164 can take the form of a protuberance, as shown in the drawings, an orifice, a ring, or any other mechanical element on which to secure a hook. The clothing rack 150 can include, as shown, several hook receivers 162, 164 to allow the user to attach the hook 136 to different points in dependence of their needs. In addition, the clothing rack 150 can include one or more hook receivers 162, 164 on both longitudinal ends of the clothing rack 150, so that at least one hook receiver 162, 164 is provided on the side of the top cover 122 regardless of how the user orients the clothing rack 150 when assembling it onto the travel bag 102. In some embodiments, the hook receivers 164 can be arranged on a side tube 152 or 154 and thus the clothing rack 150 can hang from a side tube 152 or 154, which provides several advantages: on one hand, the downward pulling weight of the top cover 122 on the side tube 152 or 154 contributes to maintain the coupling between the side tubes 152 and 154 and the receiving tubes 128; in addition, the user may choose to only assemble one side tube 152 to attach the top cover 122, and not assemble the other side tube 154 and the top hanging tube 156, should the user wish to utilize the elevated top cover 122 but not require hanging clothes from the garment rack 150. In other embodiments, hook receivers 162 can be carried by the top hanging tube 156 and thus the clothing rack 150 can hang from the top hanging tube 156; this is advantageous in that the top cover 122 downward pulling force further contributes to enhance the engagement of the top hanging tube 156 and the side tubes 152 and 154. In some embodiments, both the top tube 156 and at least one side tube 152, 154 can include hook receivers 162, 164, and the top cover 122 can thus hang from either the top tube 156 or the at least one side tube 152, 154, allowing the user to choose which advantageous effect to benefit from. In some embodiments, the strap 134 can be length-adjustable by the user, for the user to be able to tension the top cover 122 and better secure it to the clothing rack 150 in the elevated, hanging position of FIG. 1. Alternatively or additionally, the strap 134 can be elastic, in order to automatically tension the top cover 122 in the elevated, hanging position.

The foldable travel bag assembly 100 disclosed herein can adopt several configurations.

Figure 4:
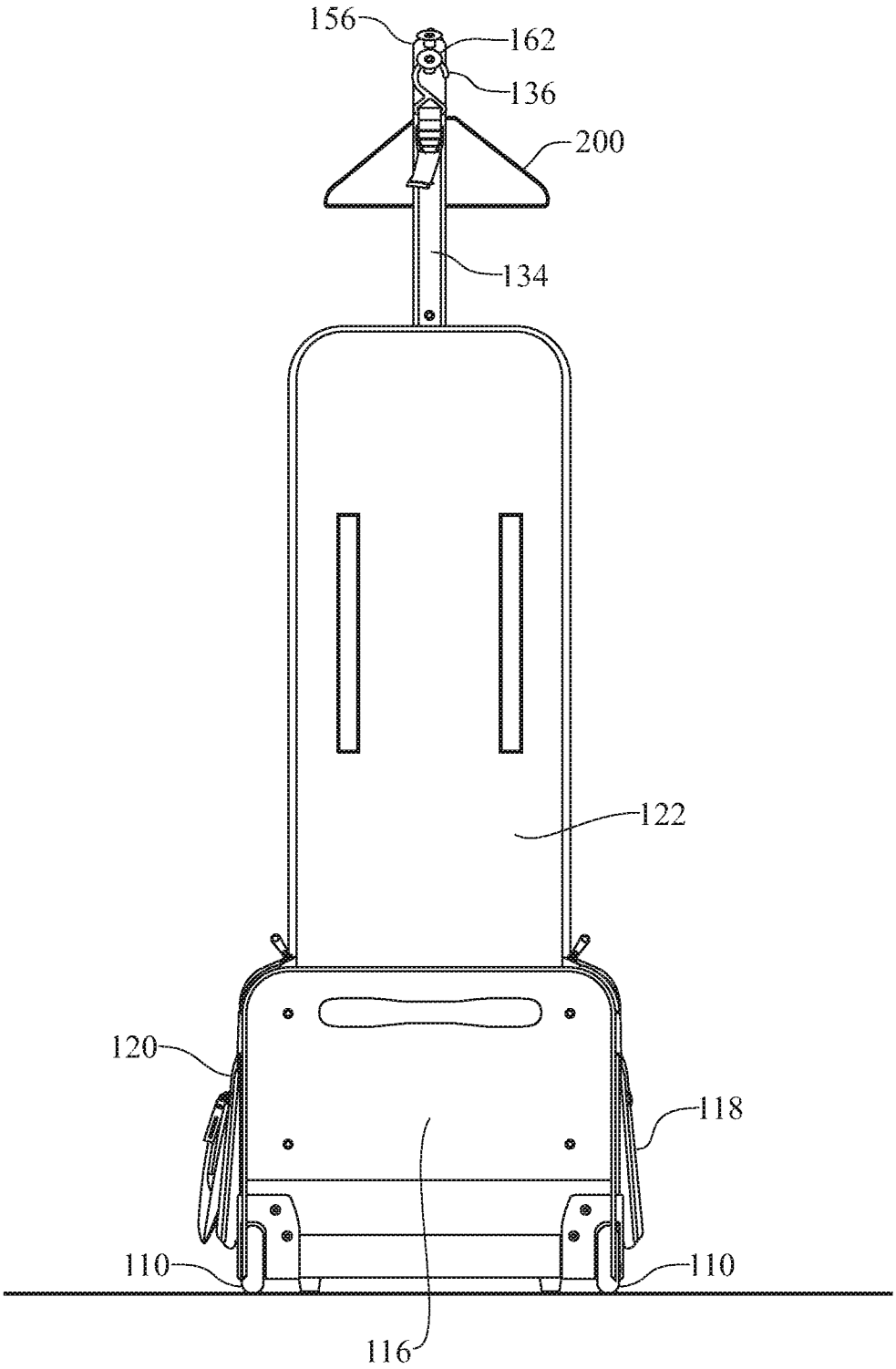
FIG. 4 presents a rear elevation view of the foldable travel bag assembly of FIG. 1, with the top cover of the travel bag shown elevated and hooked to the clothing rack as in FIGS. 1 and 3.

The illustrations of FIGS. 1, 3 and 4 present a first configuration, in which the foldable travel bag assembly 100 is deployed for use once the traveler has arrived at a hotel, temporary residence or the like. As shown, the clothing rack 150 has been firmly attached to the travel bag 102, and the top cover 122 has been hanged from the clothing rack 150 in an elevated, side position. In this configuration, the user can easily access the inside of the travel bag 102, place or retrieve items inside the pockets 130 of the top cover 122, and hang garments from hangers 200 that are in turn hanged from the top hanging tube 156 of the clothing rack 150 as shown in FIGS. 3 and 4. The rear view of FIG. 4 shows the hook 136 extending from the strap 134 and coupled to one of the hook receivers 162 of the top hanging tube 156 in a tensioned configuration, which facilitates operating the top cover 122 (e.g. zippers or other user-operable elements on the top cover 122). The preferably elastic or length-adjustable strap 134 stretches and pulls back on the hook 136 to maintain the engagement between the hook 136 and the hook receiver 162.

The illustration of FIG. 5 shows a second configuration in which the clothing rack 150 (shown in broken or hidden lines) has been disassembled and placed inside the travel bag 102, such as within the inner space 103 of the travel bag 102, and the top cover 122 has been closed and secured to the remainder of the travel bag 102 such as by a zipper (not shown) in order to prevent access to the inner space 103. The foldable travel bag assembly 100 in this second configuration is ready for traveling, for which the user can grasp the travel bag 102 from the fixed front handle 104 or the pair of opposing top handles 106 and carry the foldable travel bag assembly 100 or can grasp the travel bag 102 from the fixed front handle 104 or the extendable front handle 108 (FIG. 1) and pull the travel bag 102 to roll on the rear wheels 110.

Figure 6:
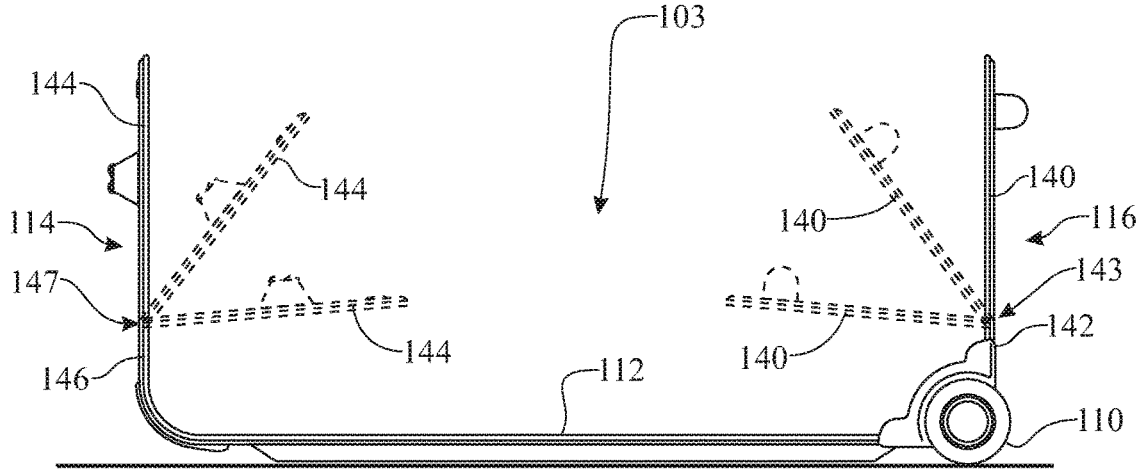
FIG. 6 presents a schematic right side elevation view of the foldable travel bag assembly of FIG. 5, having omitted the lateral sides, illustrating a sequence of folding down the longitudinal front and rear sides of the travel bag.

Parting from the configuration of FIG. 5, the foldable travel bag assembly 100 can be altered to a third configuration in which the foldable travel bag assembly 100 is collapsed and folded for storage. Arrows A shown in FIG. 5 indicate the direction in which the longitudinal front and rear sides 114 and 116 can be folded inward. The side elevation view of FIG. 6 schematically illustrates a sequence of folding down the longitudinal front and rear sides 114 and 116 of the travel bag 102. Although not shown in FIG. 6 for clarity purposes, the lateral sides 118, 120 can be folded or deformed inward as well, to follow the folding longitudinal front and rear sides 114, 116. Folding or deforming the sides 114, 116, 118 and 120 inward ultimately causes the top cover 122 to move toward the bottom side 112.

Figure 7:
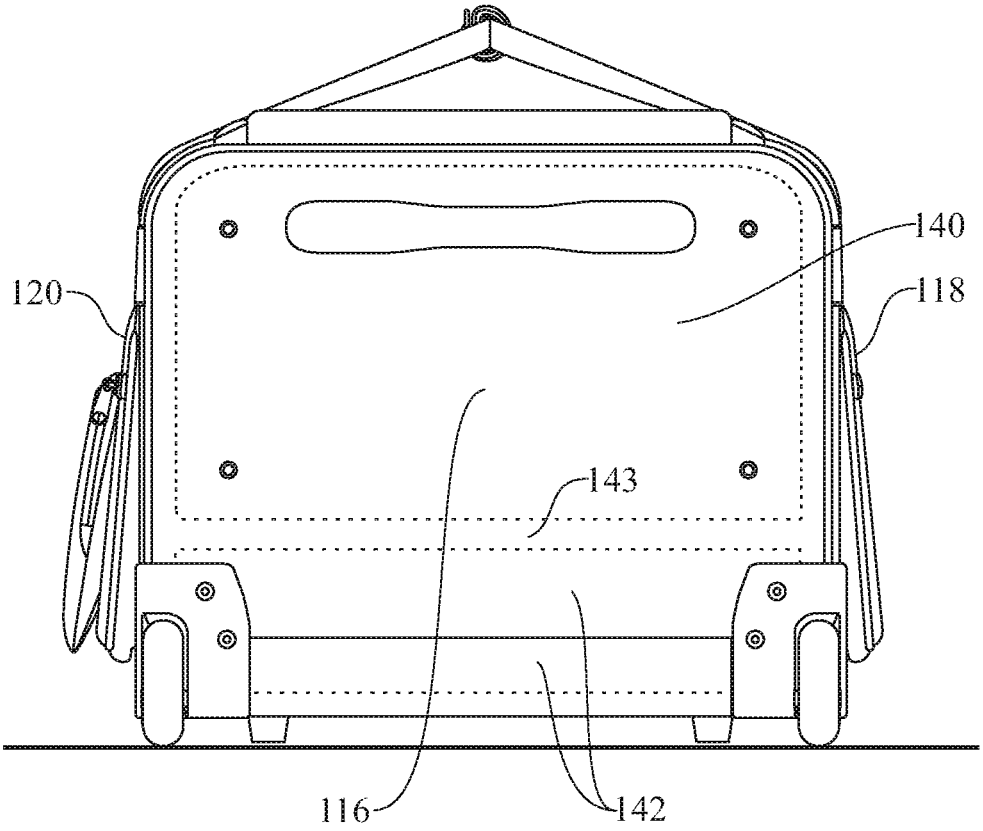
FIG. 7 presents a rear elevation view of the foldable travel bag assembly, showing the longitudinal rear side comprising two inner generally rigid (e.g. cardboard) portions slightly spaced apart to form a folding line therebetween.

As shown in FIG. 7, the longitudinal rear side 116 of the travel bag 102 can be formed of two inner rigid portions 140 and 142 (e.g., made of cardboard or hard plastic) slightly spaced apart to form a folding area or line 143 therebetween. Preferably, as shown, one inner rigid portion 140 is arranged on top of the other inner rigid portion 142, and the folding line 143 is horizontal and transverse, allowing the longitudinal rear side 116 to fold inward and downward as shown in FIG. 6. In some embodiments, a flexible (e.g. nylon) outer cover can conceal the inner rigid portions 140 and 142. The longitudinal front side 114 has a similar structure, comprising two spaced-apart rigid portions 144, 146 which are articulated about a folding area or line 147 (FIG. 6) to facilitate the inward folding. The opposed lateral sides 118 and 120 can be made from a flexible material and be deformed inward accompanying the bending of the top portions of the longitudinal front and rear sides 114 and 116.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A travel bag assembly, comprising:

a foldable travel bag defining an inner space for storing clothing, and a clothing rack removably attachable to the travel bag; wherein the travel bag assembly is configured to adopt a first position in which the clothing rack is stored inside the travel bag, and a second position in which the clothing rack is secured to the travel bag and extends upward and outward from the travel bag providing at least one clothes hanging tube in an elevated, spaced-apart relationship with the travel bag; and wherein at least one side of the travel bag comprises two rigid portions, a bending line being formed between the two rigid portions allowing the at least one side to fold towards the inner space of the travel bag.

2. The travel bag assembly of claim 1, further comprising at least one bracket on an inner face of the travel bag, the at least one bracket configured to disconnectably connect the clothing rack to said inner face of the travel bag when the travel bag assembly is arranged in the second position.

3. The travel bag assembly of claim 2, further comprising a locking mechanism configured to retain the clothing rack within the at least one bracket when the travel bag assembly is arranged in the second position.

4. The travel bag assembly of claim 1, further comprising a top cover that is openable and closable to respectively allow or prevent access to the inner space of the travel bag, wherein the travel bag assembly can further adopt a third position in which the top cover extends in an upwardly elevated position from the travel bag and is secured to the clothing rack to maintain the upwardly elevated position.

5. The travel bag assembly of claim 4, wherein the top cover comprises at least one pocket accessible through a pocket opening, and further wherein the pocket opening of each pocket is arranged above said each pocket when the travel bag assembly is arranged in the third position.

6. The travel bag assembly of claim 5, wherein the at least one pocket is arranged on an inner face of the top cover, the inner face configured to face inward and remain concealed when the top cover is closed preventing access to the inner space of the travel bag.

7. The travel bag assembly of claim 4, wherein the top cover is secured to the clothing rack by a hook fastener when the travel bag assembly is arranged in the third position.

8. The travel bag assembly of claim 4, wherein the top cover is secured to an upwardly extending side tube of the clothing rack when the travel bag assembly is arranged in the third position.

9. The travel bag assembly of claim 4, wherein the top cover is secured to the at least one clothes hanging tube when the travel bag assembly is arranged in the third position.

10. The travel bag assembly of claim 4, wherein a strap is attached to the top cover and is configured to extend from the top cover to the clothing rack when the travel bag assembly is in the third position.

11. The travel bag assembly of claim 10, wherein the strap is length-adjustable.

12. The travel bag assembly of claim 11, wherein, when the travel bag assembly is arranged in the third position, at least one side tube of the clothing rack extends upward from the travel bag and carries the at least one clothes hanging tube in a male-female fitting connection with one another and the top cover is secured to the at least one clothes hanging tube and enhances said male-female fitting connection by pulling downward due to gravity.

13. The travel bag assembly of claim 1, wherein the clothing rack comprises two side tubes, and further wherein, when the travel bag assembly is arranged in the second position, the side tubes extend upward from the travel bag in a spaced apart configuration and carry the at least one clothes hanging tube.

14. The travel bag assembly of claim 13, further comprising one or more brackets on a respective inner face of two opposite sides of the travel bag, the one or more brackets of each respective inner face configured to disconnectably connect a respective one of the two side tubes of the clothing rack to said respective inner face of the travel bag.

15. The travel bag assembly of claim 1, wherein, when the travel bag assembly is arranged in the second position, the at least one clothes hanging tube extends in a front-to-back, longitudinal direction of the travel bag assembly, the travel bag further comprising a pair of wheels on a back thereof and at least one handle on a front thereof.

16. The travel bag assembly of claim 15, wherein a front side and a rear side of the travel bag carry a respective set of one or more brackets, wherein each respective set of one or more brackets is configured to removably receive a respective side tube of the clothing rack, and further wherein, when the travel bag assembly is arranged in the second position, the side tubes of the clothing rack extend upward from the travel bag in a spaced apart configuration and carry the at least one clothes hanging tube.

17. A travel bag assembly, comprising:

a collapsible travel bag defining an inner space for storing clothing, and a clothing rack removably attachable to the travel bag; wherein the travel bag assembly is configured to adopt a first position in which the clothing rack is stored inside the travel bag, and a second position in which the clothing rack is secured to the travel bag and extends upward and outward from the travel bag providing at least one clothes hanging tube in an elevated, spaced-apart relationship with the travel bag; and wherein said travel bag is foldable in which at least one side of the travel bag comprises two rigid portions, a bending line being formed between the two rigid portions allowing the at least one side to fold towards the inner space of the travel bag.

18. A travel bag assembly, comprising:

a travel bag defining an inner space for storing clothing, the travel bag comprising a top cover that is openable and closable to respectively allow or prevent access to the inner space of the travel bag, and a clothing rack removably attachable to the travel bag; wherein the travel bag assembly is configured to adopt:

a first position in which the clothing rack is stored inside the travel bag, a second position in which the clothing rack is secured to the travel bag and extends upward and outward from the travel bag providing at least one clothes hanging tube in an elevated, spaced-apart relationship with the travel bag, and a third position in which the top cover extends in an upwardly elevated position from the travel bag and is secured to the clothing rack to maintain the upwardly elevated position; and wherein said travel bag is foldable in which at least one side of the travel bag comprises two rigid portions, a bending line being formed between the two rigid portions allowing the at least one side to fold towards the inner space of the travel bag.

19. The travel bag of claim 18, wherein a length adjustable strap is attached to the top cover for securing the top cover to said clothing rack.

20. The travel bag of claim 19, wherein said length adjustable strap is attached to said top cover for securing said top cover to said clothes hanging tube.

* * * * *